US010077514B2

(12) United States Patent
Jiang et al.

(10) Patent No.: US 10,077,514 B2
(45) Date of Patent: Sep. 18, 2018

(54) METHOD FOR FORMING FALL-PLATE WEAVE BY USING GROOVE PIN WARP KNITTING MACHINE BASED ON SERVO DRIVING

(71) Applicant: JIANGNAN UNIVERSITY, Wuxi, Jiangsu (CN)

(72) Inventors: Gaoming Jiang, Jiangsu (CN); Honglian Cong, Jiangsu (CN); Fenglin Xia, Jiangsu (CN); Xuhong Miao, Jiangsu (CN); Ailan Wan, Jiangsu (CN); Jiajia Peng, Jiangsu (CN)

(73) Assignee: JIANGNAN UNIVERSITY, Wuxi, Jiangsu (CN)

( * ) Notice: Subject to any disclaimer, the term of this patent is extended or adjusted under 35 U.S.C. 154(b) by 0 days.

(21) Appl. No.: 15/327,550

(22) PCT Filed: Oct. 9, 2014

(86) PCT No.: PCT/CN2014/088160
§ 371 (c)(1),
(2) Date: Jan. 19, 2017

(87) PCT Pub. No.: WO2015/180360
PCT Pub. Date: Dec. 3, 2015

(65) Prior Publication Data

US 2017/0159213 A1 Jun. 8, 2017

(30) Foreign Application Priority Data

May 26, 2014 (CN) ..... 2014 1 0226717

(51) Int. Cl.
*D04B 21/06* (2006.01)
*D04B 27/02* (2006.01)
(Continued)

(52) U.S. Cl.
CPC ..... *D04B 21/06* (2013.01); *D04B 27/02* (2013.01); *D04B 27/08* (2013.01); *D04B 27/24* (2013.01)

(58) Field of Classification Search
CPC ..... D04B 21/12; D04B 21/06; D04B 27/02; D04B 27/08; D04B 27/24
See application file for complete search history.

(56) References Cited

U.S. PATENT DOCUMENTS 3,707,853 A * 1/1973 Lindner ..... D04B 23/08 66/84 R
4,202,185 A * 5/1980 Lesley ..... D04B 27/06 66/104
(Continued)

FOREIGN PATENT DOCUMENTS

CN 201842949 U 5/2011
CN 103741366 A 4/2014
(Continued)

OTHER PUBLICATIONS i International Search Report dated Feb. 17, 2015; PCT/CN2014/088160.

*Primary Examiner* — Danny Worrell
(74) *Attorney, Agent, or Firm* — Ladas & Parry LLP

(57) ABSTRACT

A method for knitting fall-plate structures on warp-knitting machines, including: the fall-plate guide bar makes an overlap when the groove needle bar is going upward and the previous loop is held by the sinker bar; the groove needle bar and the tongue bar simultaneously go downward but these two items are kept not closed, and the overlapped yarn and the previous loop are slipping inside together; the groove needle bar go upward again while both the fall-plate yarn and the previous loop are held by the sinker bar, making the two yarns slip out of the groove needle. Meanwhile, a ground guide bar makes an overlap, finishing lapping. When
(Continued)

Figure 1:
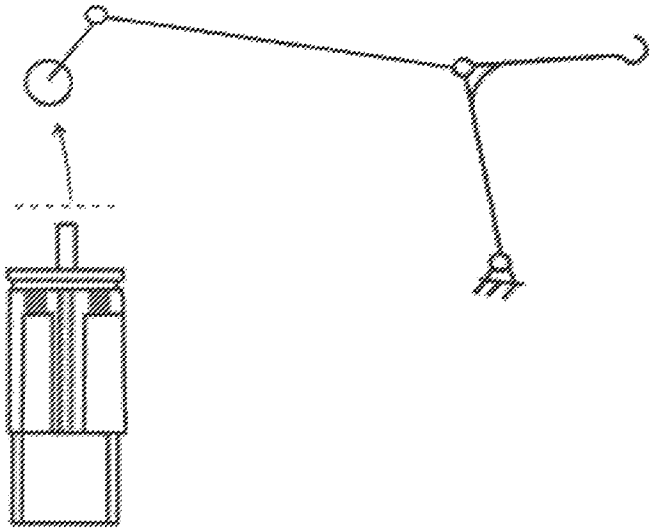

moving the groove needle bar downward for a second time, retreating the old loop and the pressed yarn; forming a new loop, by the ground yarn; placing the pressed yarn under the new loop; and forming the fall-plate structures.

7 Claims, 7 Drawing Sheets

(51) Int. Cl.
*D04B 27/24* (2006.01)
*D04B 27/08* (2006.01)

(56) References Cited

U.S. PATENT DOCUMENTS 4,389,860 A * 6/1983 Schneider ..... D04B 23/08
66/84 R
5,515,701 A * 5/1996 Schubert ..... D04B 21/02
66/204
5,653,127 A * 8/1997 Berger ..... D04B 21/18
66/203

FOREIGN PATENT DOCUMENTS

| | | | |
|---|---|---|---|
| CN | 103966756 | A | 8/2014 |
| DE | 19739540 | C1 | 3/1999 |
| DE | 19801601 | C1 | 3/1999 |
| GB | 2023195 | A | 12/1979 |
| JP | 06-235151 | A | 8/1994 |

* cited by examiner

METHOD FOR FORMING FALL-PLATE WEAVE BY USING GROOVE PIN WARP KNITTING MACHINE BASED ON SERVO DRIVING

TECHNICAL FIELD

The present invention is related to a kind of method of forming the fall-place structure, and more particularly, related to a kind of method of forming the fall-place structure by using the groove needle warp knitting machine based on the servo driving.

BACKGROUND OF THE TECHNOLOGY

The yarn pressing warp weaving structure will be a kind of warp weaving structure in which the liner yarn will be wound around the base part of the loop.

The liner yarn will not be knitted into a loop, will be wound around the base part of the loop, and the other parts will be wound on the ground structure, so as to obtain the three-dimensional effect of the fabric.

The pattern effect which is formed by utilizing the fall-place structure, such as the emboss effect, has been widely used in the fabric, home textiles and so on.

At present, the fall-place structure has been woven on the warp knitting machine with the yarn pressing plate mechanism; when the yarn pressing plate is on the top, the yarn pressing comb and the yarn pressing plate will swing together over the weaving needle, to perform the yarn laying movement before the needle; after the yarn pressing comb finished the yarn laying before the needle and swing back to the front of the machine, the yarn pressing plate will descend, so as to press down the pressed yarn which has been laid just now to the needle bar.

When the weaving needle subsequently descends to form the loop of the ground yarn, the pressed yarn will be removed from the needle head together with the old loop.

This kind of method for forming the fall-place structure has restricted the traverse movement direction of the yarn pressing comb and the ground comb, in general, the directions of the traverse movement before the needle of the yarn pressing comb and the ground comb are opposite; if the yarn pressing comb and the ground comb perform the yarn laying in the same direction in front of the needle, the pressed yarn and the ground yarn are laid in parallel on the weaving needle, when the yarn pressing plate is pressed down, the pressed yarn and the ground yarn will be pressed down together.

For this kind of conventional method for forming the fall-place structure, the low-strength yarn could not be adopted as the pressed yarn, the low strength will cause the yarn breakage when the yarn is under the pressure of the yarn pressing plate.

The utilization of the conventional formation method has become impossible to meet the development trend of flower pattern diversification today.

The fall-place structure which is formed by the utilization of the groove needle requires no use of the yarn pressing plate, making it possible for the development of the fall-place structure without the limitation of the machines, so as to increase the speed of product development and expand the scope of the development of varieties.

Technical Problems

The object of the present invention is to overcome the shortcomings of the existing technology, provide a kind of method for forming the fall-place structure by using the groove needle warp knitting machine based on the servo driving, which will be driven by the servo motor, so as to respectively control the groove needle bar and the needle core to form the fall-place structure, and change the existence of the yarn pressing plate in the conventional technology, and simplify the machine structure.

Solution of the Problems

Technical Solution

It is the technical solution which is provided according to the present invention, and it is a kind of method for forming the fall-place structure by using the groove needle warp knitting machine based on the servo driving, which will be performed on a Raschel groove needle warp knitting machine, wherein the above mentioned groove needle bar and the tongue bar of the warp knitting machine will be respectively connected with two servo motors through the connecting-rod mechanism, and two servo motors will respectively and separately control the groove needle bar and the tongue bar;

and the specific steps are:

a. during the progress when the groove needle bar is raised for the first time, the sinker will press against the old loop, the fall-plate guide bar will perform the traverse movement before the needle, the pressed yarn will finish the yarn laying, while the ground guide bar will not perform the traverse movement before the needle;

b. the groove needle bar and the tongue bar will descend, the groove needle bar will be kept open, and the pressed yarn and the old loop will go together to the inside of the needle hook the groove needle bar;

c. during the progress when the groove needle bar is raised for the second time, the sinker will press against the old loop and the pressed yarn, the old loop and the pressed yarn will slide together onto a needle rod of the groove needle bar; the ground guide bar will perform the traverse movement before the needle, the ground yarn will finish the yarn laying, while the fall-plate guide bar will not perform the traverse movement before the needle;

d. the groove needle bar will descend for the second time, the tongue bar and the groove needle bar will be closed, the old loop and the pressed yarn will retreat from the ring together, the ground yarn will form a new loop, the pressed yarn will be wound around the bottom of the new loop, and then the fall-place structure will be formed.

Further, in the above mentioned step a, during the first time rise of the groove needle bar, the groove needle bar will be raised earlier than the tongue bar, and the rising speed of the groove needle bar will be greater than the rising speed of the tongue bar.

Further, in the above mentioned step d, at the same time when the groove needle bar is descending, the fall-plate guide bar will perform the traverse movement of the needle back.

Further, the direction of the traverse movement before the needle of the fall-plate guide bar when the above mentioned groove needle is raised to the uppermost position for the first time will be the same as or opposite to the direction of the traverse movement of the ground guide bar when the groove needle is raised to the uppermost position for the second time.

Further, in the above mentioned step a, the fall-plate guide bar and the ground guide bar will swing together toward the front of the needle, and swing to the utmost front position, and the fall-plate guide bar will perform the traverse movement before the needle.

Further, in the above mentioned step c, the ground guide bar and the fall-plate guide bar will swing together toward the front of the needle, and swing to the utmost front position, and the ground guide bar will perform the traverse movement before the needle.

Further, when the above mentioned groove needle is raised twice, one course is completed, and the spindle is rotated for one cycle.

Beneficial Effect of the Invention

Beneficial Effect

The present invention has the following advantageous points:

(1) The present invention utilizes the method of twice rising of the groove needle to form the press yarn structure; comparing with the conventional method of using the yarn pressing plate to press down the yarn for forming the fall-place structure, at the time of the yarn laying in the same direction, there is no need to consider that the yarn pressing plate may press down the ground yarn together which may result in the failure to form the fall-place structure, the ground yarn and the pressed yarn can perform the yarn laying in any direction for forming the fall-place structure.

(2) The present invention utilizes the method of twice rising of the groove needle to form the press yarn structure, the conventional method of utilizing the yarn pressing plate to form the ground yarn of the fall-place structure is changed to the method of utilizing twice rising of the groove needle to form the press yarn structure, the pressed yarn will not be subjected to the pressing force which will be generated by the downward pressing of the yarn pressing plate, therefore, the yarn with lower strength can be used as the pressed yarn for weaving.

This expands the range of the usable raw materials of the fabric that will be formed by the method of the present invention.

(3) The pressed yarn can perform the yarn laying in any direction, it is possible to form the pattern effect similar to the hawse pattern in the sweater structure and so on, the utilization of twice rising of the groove needle to form the fall-place structure is possible to form various structures such as the embroidery pattern, the entangled pressed yarn, the interwoven structure in latitude and longitude direction and other structures.

BRIEF EXPLANATION OF THE ATTACHED FIGURES

Explanation of the Attached Figures

FIG. 1 will be a schematic diagram of the process that a servo motor will control the groove needle bar through the connecting-rod mechanism.

Figure 2:
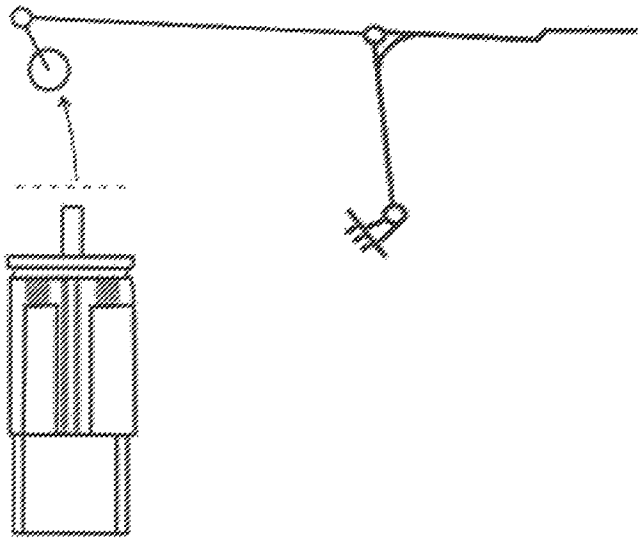

FIG. 2 will be a schematic diagram of the process that the servo motor will control the tongue bar through the connecting-rod mechanism.

Figure 3:
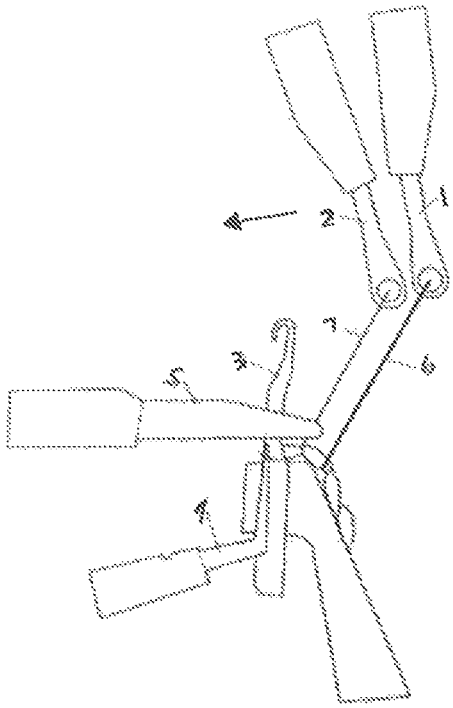

FIG. 3 will be a schematic view of the first time rising process of the groove needle bar in the Embodiment 1.

Figure 4:
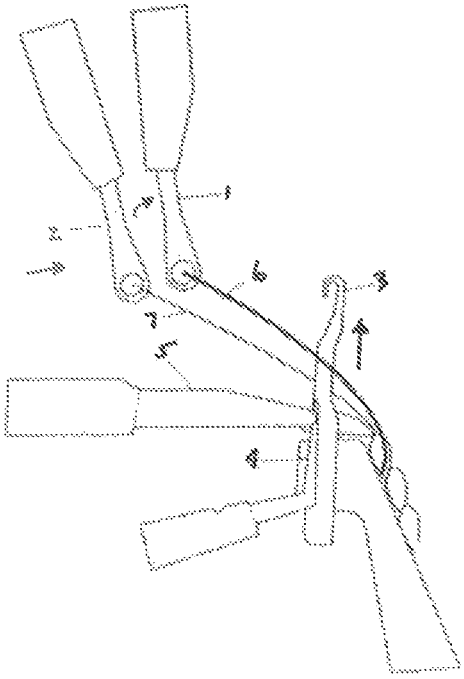

FIG. 4 will be a schematic view of the process that the groove needle bar is raised for the first time, the fall-plate guide bar will perform the yarn laying before the needle in the Embodiment 1.

Figure 5:
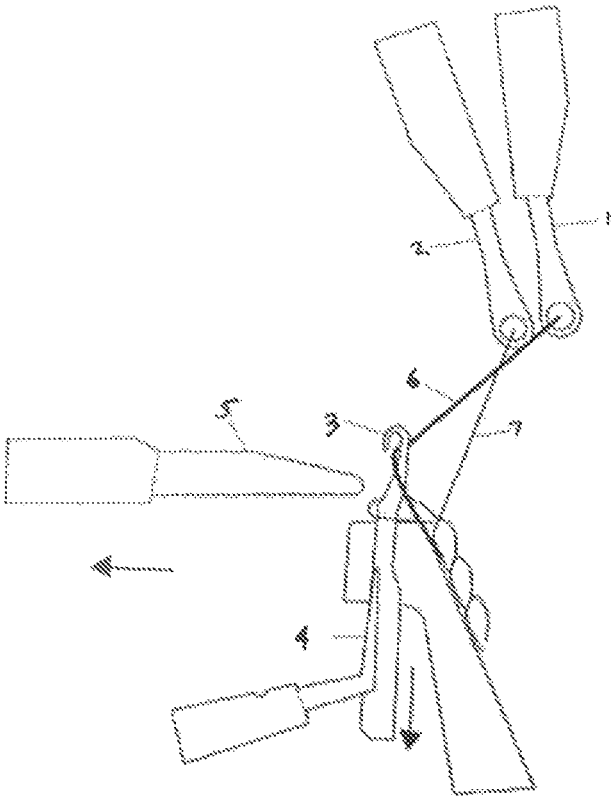

FIG. 5 will be a schematic view of the process that the fall-plate guide bar will finish the yarn laying before the needle in the Embodiment 1.

Figure 6:
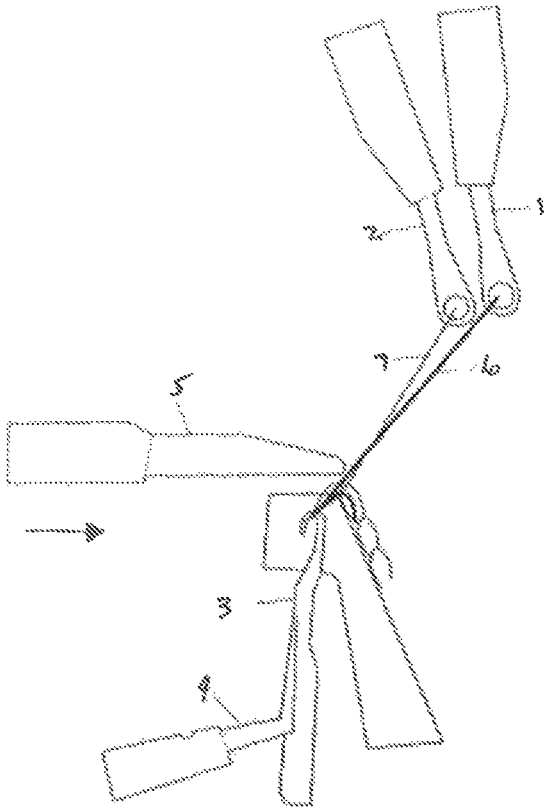

FIG. 6 will be a schematic view of the first time descending process of the groove needle bar in the Embodiment 1.

Figure 7:
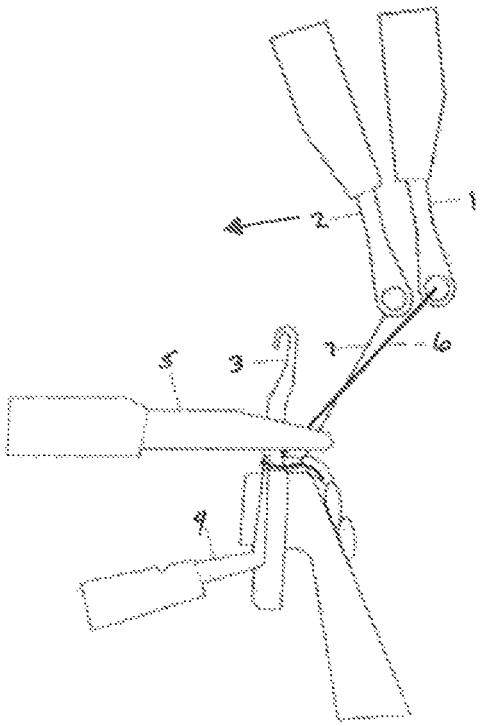

FIG. 7 will be a schematic view of the second time rising process of the groove needle bar in the Embodiment 1.

Figure 8:
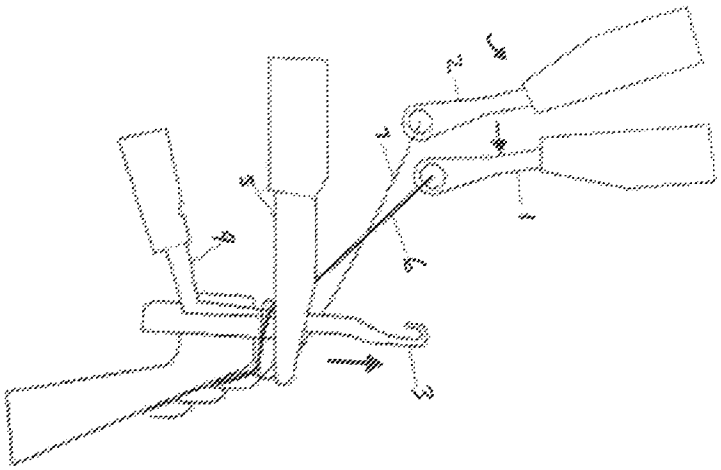

FIG. 8 will be a schematic view of the process that the groove needle bar is raised for the second time, the ground guide bar will perform the yarn laying before the needle in the Embodiment 1.

Figure 9:
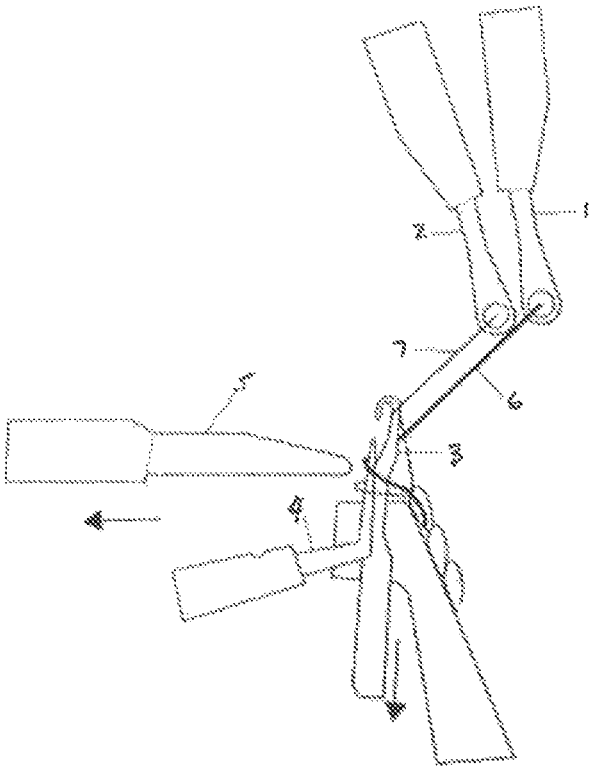

FIG. 9 will be a schematic view of the process that the ground guide bar will finish the yarn laying before the needle in the Embodiment 1.

Figure 10:
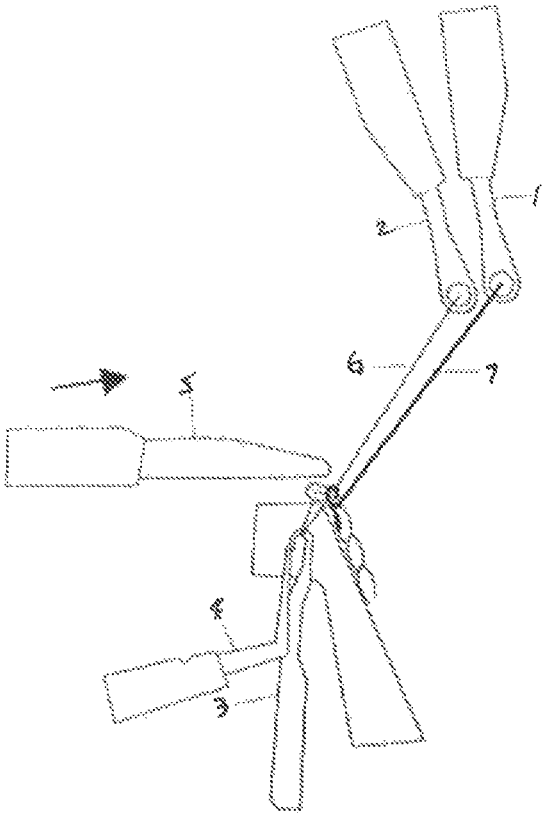

FIG. 10 will be a schematic view of the second time descending process of the groove needle bar in the Embodiment 1.

In the figure, the serial numbers are: the fall-plate guide bar 1, the ground guide bar 2, the groove needle bar 3, the tongue bar 4, the sinker 5, the pressed yarn 6, and the ground yarn 7.

METHOD FOR THE IMPLEMENTATION OF THE PRESENT INVENTION

In the following, the present invention will be further described in details with reference to the attached figures.

The method for forming the fall-place structure which is described by the present invention will be implemented on the Raschel groove needle warp knitting machine, the groove needle on the warp knitting machine will be composed of the groove needle bar and the tongue bar; the groove needle bar and the tongue bar will be respectively connected with two servo motors through the connecting-rod mechanism, and two servo motors will respectively and separately control the groove needle bar and the tongue bar, as shown in the FIG. 1 and FIG. 2.

Embodiment 1

The ground guide bar 2 and the fall-plate guide bar 1 will perform the yarn laying in the opposite direction; taking the woven fabric which is formed by the combination of the braiding structure and the fall-place structure as an example, the yarn laying quantity of the ground structure is: 0-1/1-0//, the yarn laying quantity of the fall-place structure is: 1-0/1-2//.

FIG. 3~FIG. 10 will be the schematic views of the process of utilizing twice rising of the groove needle to finish the yarn laying quantity of the ground structure at 0-1, and the yarn laying quantity of the fall-place structure at 1-0.

Among them, FIG. 3~FIG. 6 will be the schematic views about finishing the yarn laying before the needle of the pressed yarn 6.

As shown in the FIG. 3, the groove needle will be raised for the first time to realize the normal retreat from the ring, after that, the tongue bar 4 will start to rise; and the rising speed of the groove needle bar 3 will be greater than the rising speed of the tongue bar 4, so as to open the needle mouth; in order to ensure that the tongue bar 4 will not hinder the retreat from the ring, when the tongue bar 4 is raised to the old loop holding plane, it will be completely sunken in the needle groove on the groove needle bar 3; during the process of the first time rise of the groove needle, the sinker 5 will press against the old loop. As shown in the FIG. 4, when the groove needle bar 3 is raised to a certain height, the fall-plate guide bar 1 and the ground guide bar 2 will swing toward the front of the needle, and swing to the utmost front position; the fall-plate guide bar 1 is prepared to perform the traverse movement before the needle, and the ground guide bar 2 will not move.

As shown in the FIG. 5, the fall-plate guide bar 1 will perform the traverse movement before the needle, finish swinging from the position on the right side of the first needle to the position on the left side, the pressed yarn 6 will finish the yarn laying, and the ground guide bar 2 will swing together with the fall-plate guide bar 1 toward the rear of the needle, the groove needle bar 3 and the tongue bar 4 will descend, and the sinker 5 will move toward the rear.

As shown in the FIG. 6, the groove needle bar 3 and the tongue bar 4 will continue to descend to the lowest point, and remain unclosed all the time; the pressed yarn 6 and the old loop will go together to the needle hook of the groove needle bar 3, and the sinker 5 will move toward the front.

FIG. 7~FIG. 10 will be the schematic views of the process of finishing the yarn laying before the needle of the yarn in the weaving chain structure.

As shown in the FIG. 7, the groove needle will be raised for the second time, the old loop and the pressed yarn 6 will be raised with the groove needle bar 3, and the sinker 5 will press against the old loop and the pressed yarn 6; the groove needle bar 3 will be raised, the tongue bar 4 will be raised together with the groove needle bar 3, the needle mouth will remain the open state, the old loop and the pressed yarn 6 will slide together onto the needle bar of the groove needle bar 3.

As shown in the FIG. 8, the groove needle bar 3 will continue to rise until the highest position, the ground guide bar 2 and the fall-plate guide bar 1 will swing forward together, and swing to the utmost front position, the ground guide bar 2 is prepared to perform the traverse movement before the needle, and the fall-plate guide bar 1 will not move.

As shown in the FIG. 9, the ground guide bar 2 will perform the traverse movement before the needle, swing from the left side of the first needle to the right side, opposite to the direction of the traverse movement of the fall-plate guide bar 1, the ground yarn 7 will finish the yarn laying, the fall-plate guide bar 1 will swing together with the ground guide bar 2 toward the rear of the needle, the groove needle bar 3 will start to descend, after descended for a certain distance, the tongue bar 4 will also start to descend, and the sinker 5 will move toward the rear.

At the same time when the groove needle bar 3 descends, the fall-plate guide bar 1 will perform the traverse movement of the needle back, swing from the right side of the first needle to the right side of the second needle.

The descending speed of the tongue bar 4 will be slower than that of the groove needle bar 3, until the needle hook tip of the groove needle bar 3 meets the head end of the tongue bar 4, at this time, the needle mouth will be completely closed, the old loop and the pressed yarn 6 will be looped in the ring, the groove needle bar 3 and the tongue bar 4 will move downward at the same speed.

As shown in the FIG. 10, the old loop and the pressed yarn 6 will exit the ring, the ground yarn 7 will form the new loop, and the pressed yarn 6 will be wound around the bottom part of the new loop to form the fall-place structure.

In the above mentioned process, after twice rising of the groove needle bar 3, the pressed yarn loop will be wound around the base part of the loop, the fall-plate guide bar will perform the traverse movement of the needle back, swing from the right side of the first needle to the right side of the second needle.

After the traverse movement of the needle back is finished, twice rising of the groove needle will be utilized to form the fall-place structure.

In addition, at the time when the yarn pressing comb is performing the yarn laying, it will swing from the left side of the needle to the right side of the needle, and the ground comb will swing from the right side of the needle to the left side of the needle, so as to perform the yarn laying in the opposite direction.

When the groove needle bar rises and descends twice, only one course will be woven, and the spindle will rotate by one cycle.

Embodiment 2

The ground guide bar 2 and the fall-plate guide bar 1 will perform the yarn laying in the same direction; taking the woven fabric which is formed by the combination of the braiding structure and the fall-place structure as an example, the yarn laying quantity of the ground structure is: 0-1/1-0//, the yarn laying quantity of the fall-place structure is: 0-1/2-1//.

Embodiment 2 is to utilize the fall-plate guide bar 1 and the ground guide bar 2 to perform the yarn laying in the same direction for forming the fall-place structure, and the difference from the Embodiment 1 is that the direction of the traverse movement of the fall-plate guide bar 1 when the groove needle bar 3 is raised to the highest position for the first time will be same as the direction of the traverse movement of the ground guide bar 2 when the groove needle bar 3 is raised to the highest position for the second time.

The invention claimed is:

1. A method for forming fall-plate structures by using a grooved needle warp knitting machine, the grooved needle comprising a groove needle bar and a tongue bar; wherein the groove needle bar and the tongue bar are connected to linkage and two servo motors, and the two servo motors respectively and separately control the groove needle bar and the tongue bar, comprising:

a. moving the groove needle bar upward for a first time; pressing, by the sinker bar, an old loop; and looping, by a fall-plate guide bar, a pressed yarn around the groove needle, wherein a ground guide bar does not loop a ground yarn around the groove needle, b. moving the groove needle bar and the tongue bar downward for a first time; and placing the pressed yarn and the old loop inside of a needle hook of the groove needle bar, c. moving the groove needle bar upward for a second time; pressing, by the sinker bar, the fall-plate yarn and the previous loop to slip out of the needle hook of the groove needle bar; and looping, by the ground guide bar, the ground yarn around the groove needle, wherein the fall-plate guide bar does not loop the pressed yarn around the groove needle, and d. moving the groove needle bar downward for a second time; closing, by the tongue bar, the needle hook of the groove needle bar, wherein the closed hook includes the ground yarn; retreating the old loop and the pressed yarn from the closed hook; forming, by the ground yarn, a new loop; and placing the pressed yarn under the new loop.

2. The method of claim 1, wherein when moving the groove needle bar upward for the first time, the groove needle bar is moved up before the tongue bar is moved up, and a moving speed of the groove needle bar is greater than a moving speed of the tongue bar.

3. The method of claim 1, wherein when the groove needle bar is moved downward for the second time, the pressed yarn is, by the fall-plate guide bar, placed below the ground yarn.

4. The method of claim 1, wherein a looping direction of the fall-plate guide bar when the groove needle is moved up for the first time and a looping direction of the ground guide bar when the groove needle is moved up for the second time are a same or opposite direction.

5. The method of claim 1, wherein when the groove needle bar is moved up for the first time, the fall-plate guide bar and the ground guide bar move toward an open area of the needle hook of the groove needle bar, pass the open area of the needle hook of the groove needle bar, and the fall-plate guide bar swings and loops the pressed yarn around the groove needle bar.

6. The method of claim 1, wherein when the groove needle bar is moved upward for the second time, the ground guide bar and the fall-plate guide bar move toward an open area of the needle hook of the groove needle bar, pass the open area of the needle hook of the groove needle bar, and the ground guide bar swings and loops the ground yarn around the groove needle bar.

7. The method of claim 1, wherein when the groove needle bar is moved upward for the second time, one course is completed, and a spindle is rotated for one cycle.

* * * * *